US005648793A

United States Patent [19]

Chen

[11] Patent Number: 5,648,793

[45] Date of Patent: Jul. 15, 1997

[54] DRIVING SYSTEM FOR ACTIVE MATRIX LIQUID CRYSTAL DISPLAY

[75] Inventor: Yen-Chen Chen, Hsinchu, Taiwan

[73] Assignee: Industrial Technology Research Institute, Hsinchu, Taiwan

[21] Appl. No.: 818,132

[22] Filed: Jan. 8, 1992

[51] Int. Cl.[6] ..... G09G 3/36

[52] U.S. Cl. ..... 345/96; 345/94; 345/209

[58] Field of Search ..... 340/784, 805; 359/84, 85; 345/94, 100, 96, 209

[56] References Cited

U.S. PATENT DOCUMENTS

| | | | |
|---|---|---|---|
| 3,938,136 | 2/1976 | Kawakami | 340/784 |
| 4,258,364 | 3/1981 | Kaufmann et al. | 340/784 |
| 4,830,466 | 5/1989 | Matsuhashi et al. | 340/784 |
| 4,909,607 | 3/1990 | Ross | 340/805 X |
| 5,014,048 | 5/1991 | Knapp | 340/784 |

OTHER PUBLICATIONS

Y. Asai et al, "A.6.7–in Square High–Resolution full–color TFT–LCD", Japan Display, 1989, pp. 514–517.

*Primary Examiner*—Richard Hjerpe
*Assistant Examiner*—Amare Mengistu

[57] ABSTRACT

A driving system for matrix liquid crystal display in which the picture elements in adjacent rows and/or adjacent columns are applied with signals of opposite polarities. These polarities are reversed for every other field of a picture frame. Such a system reduces flicker and cross-talk. The system is implemented by interleaving the precharging and charging signals of adjacent picture elements.

9 Claims, 5 Drawing Sheets

DRIVING SYSTEM FOR ACTIVE MATRIX LIQUID CRYSTAL DISPLAY

BACKGROUND

The present invention is related to a method of driving a matrix liquid crystal display, particularly a high capacity display device.

For flat panel displays, liquid crystals can be used as pictures elements (pixels). These pixels are arranged in a matrix and each pixel can be actuated through a switch, typically implemented with a thin film transistor TFT). The switch is turned on by means of two-dimensional X–Y addressing such as that used in a random-access memory.

A typical block diagram is shown in FIG. 1(A). In this figure, the pixels, such as P11 and P21, are located at the cross-points of an X–Y matrix. The matrix of the liquid crystal display panel has n rows in the X-direction and m columns in the Y-direction. Hence, there are mXn TFTs, such as 1*a*, as well as liquid display elements, such as 1*b*. The TFTs function as switches for actuating the liquid crystal pixels. The scanning electrodes (the gates) of the TFTs in the same row are connected together and driven from drivers with outputs G1, G2, . . . , Gm. The input terminals of the switches (say, the sources) in the same column are connected together and fed with pulsed information or data signals.

FIG. 1(B) shows the scanning waveforms in different parts of a conventional system with labels corresponding to that in FIG. 1(A). The pulsed waveforms G1, G2, G3, G4 are successively delayed by one dwell time of a horizontal line, which is equal to the horizontal scan time. These waveforms are applied to the rows G1, G2, . . . , Gm respectively to control the gates of the TFTs. In this manner, the TFTs are sequentially turned on for information signals to be impressed on the corresponding liquid crystals.

When the TFT is turned on, the information or data voltages are impressed on the liquid crystals for display. These voltages stay with the corresponding liquid crystals until the signal voltage is reset or inverted when no signal of the same color is applied to the liquid crystals.

In the foregoing description, the scanning bus G1, G2, . . . , Gm in FIG. 1(A) have voltage waveforms shown in FIG. 1(B). Under ideal condition, this waveform is not distorted or delayed, and the system should perform well. In actual conditions, each TFT has finite on resistance and the liquid crystal is a capacitive element. As a result, there is a finite charging and discharging time for the picture elements to reach the desired signal voltage. Since the dwell time of the signal for each pixel is very short, the pixel may not have enough time to be charged up to the desired signal voltage, causing the display to darken.

Tekeda etal disclosed in U.S. Pat. No. 4,651,148 a method to overcome this problem by not only charging the addressed pixel but also precharging the following pixel simultaneously. The precharging can shorten the time for the addressed pixel to attain its final voltage. Precharging is effected either by using a longer addressing pulse than the dwell time of pixel or by using double pulses, one for precharging and the other for charging the liquid crystal to its final value. The first version is to lengthen the row control pulses to double the duration of the dwell time as shown in FIG. 2, G1, G2, G3, G4 waveforms. Note that G2 overlaps with G1 for one dwell time.

In another version, double pulses are used for precharging a and charging. FIG. 3 shows the waveforms at different points of Tekeda's double pulse system. The scan pulses are applied twice as shown in waveforms G1, G2, G3, G4, which are applied to the (i-3)th through (i)th row electrodes, whereas D1 shows the data signal waveforms for three colors, R, G, B, applied to the (j)th column electrode addressed. Compared to the conventional drive waveform D1, the drive waveform P11' substantially expands the scan pulse width by preliminary charging the electrode with data signals fed from the same color row that precedes the (n)th row. Waveform P11' shows the potential of the display picture electrodes in the (i)th row and the (j)th column. $V_{i-n}$ and $V_i$ respectively indicate the data voltages dealing with the (i–n)th row and the (i)th row. In the beginning of each field, each picture element remains charged in a reversed polarity by the preceding field. Next, when the switching transistor turns on, the display picture element electrode in the (i)th row and the (j)th column start the preliminary charge against the data voltage $V_{i-n}$ that precedes the (n)th row. The switching transistor then turns off during $H_{i-n+1}$ through $H_{i-n}$ periods and again turns on during the next $H_i$ period, thus activating charge against the data voltage $V_i$. As a result, a charge curve such as that shown in P11' is achieved, allowing these electrodes to charge voltages to such a level higher than the conventional drive method shown in P11. When the data signals $V_{i-n}$ and $V_i$ contain the same colors as in the TV pictures and have a relationship close to each other, the Tekeda drive method then provides the same effect as if the RC time constant were reduced.

The Tekeda method, however, has some serious drawbacks. These drawbacks are due to the inversion of the same polarity voltage signal occurring in the same vertical scanning field and the overlapping of same color signals also occurring in the same field. This situation causes serious flickering and cross-talk problems.

In the Tekeda method, the signal of the same color is impressed on the liquid crystals only during every alternate field. As shown in FIG. 4(A), the signal is applied only during the first field when they are positive. The voltages at the liquid crystals reset to a negative voltage or inverted in during the second field. The absence of signal during the second field makes the signal flicker at a 1/30 rate instead of 1/60 rate. Thus the flickering effect is more pronounced.

The second drawback of the Tekeda system is that the overlapping of the pulses of the same color as shown in FIG. 3, waveforms G1 and G4. In both versions of the Tekeda method, the resultant signal voltage applied to the two neighboring pixels of the same color is indicated as P11 and P21 in FIG. 2. Note that in the middle interval when the driving pulses on G1 and G2 overlap, signals appear both in P11 and P21. Such an overlap of signals may cause cross-talk. This problem arises because the polarity of all the drive voltages such as P11, P21, etc are of the same polarity in the first field, before the polarity is inverted or reset in the second field as shown in FIG. 4(A). In other words, the Tekeda system only has field inversion, which is inadequate.

SUMMARY

The object of this invention is to eliminate flicker in a matrix liquid crystal television display. Another object of this invention is to eliminate cross-talk in the display. Still another object of this invention is to implement row inversion and dot inversion in a matrix liquid crystal television display.

These objects are achieved in this invention by using row inversion and dot inversion instead of the field inversion method. With row inversion, the signals of the scan lines of one field are interlaced with the signals of second field, thus reducing flicker due to all same polarity voltage signals appearing in the same field. With dot inversion, signals appear at every odd dots in the first line and appear at even dots in the next line for the first field, but are reversed in the second field. In so doing, the flicker and cross-talk can further be eliminated.

DETAILED DESCRIPTION OF THE PREFERRED EMBODIMENT

Figure 5:
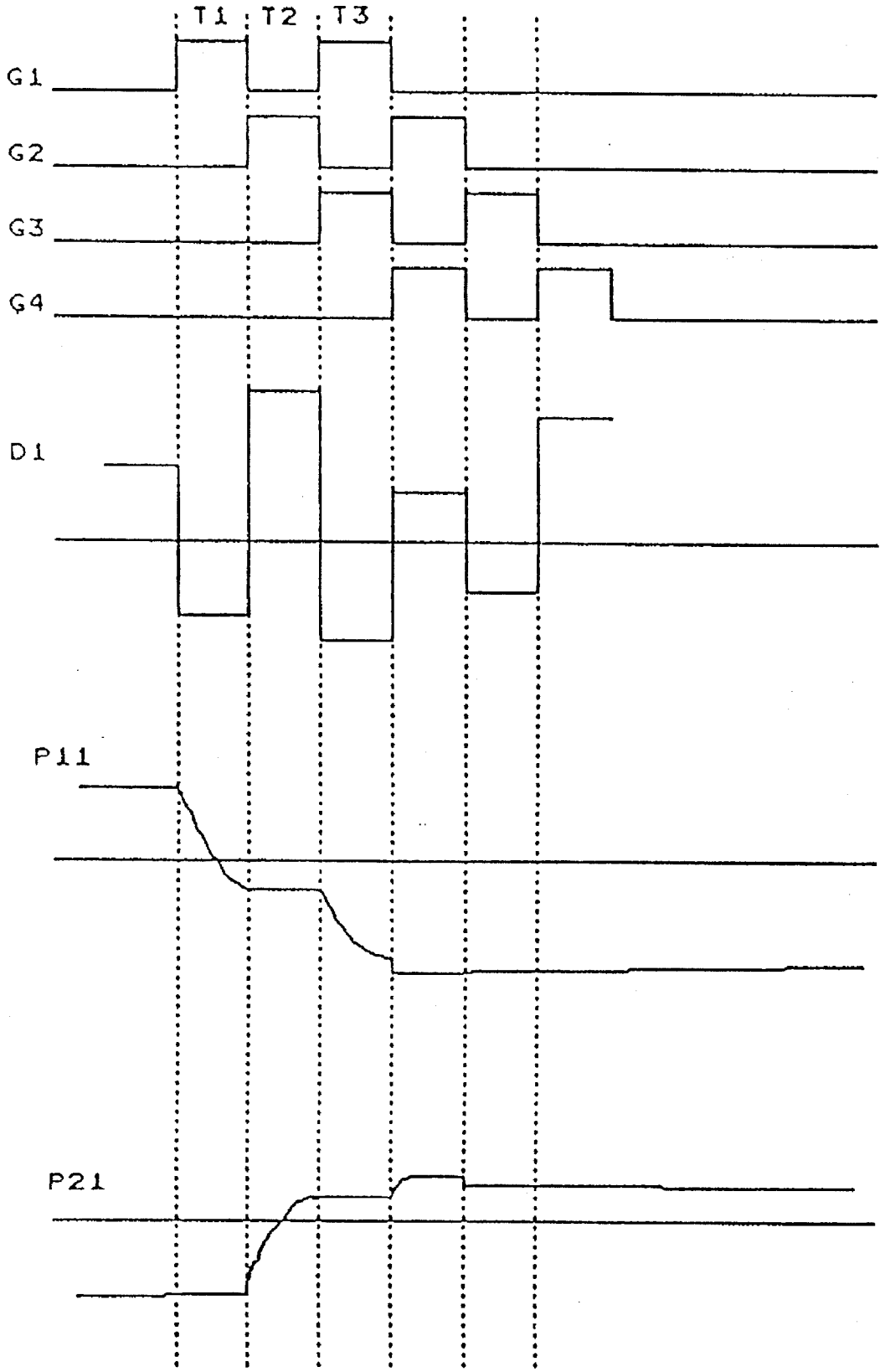
FIG. 5 shows the waveforms at different points using the row inversion scheme according to this invention.

Referring to the matrix arrangement of the liquid crystal display shown in FIG. 5, G1, G2, G3, G4 are the row control lines. According to this invention, the control signal for each pixel has two pulses. For instance, the control signal on G1 has one pulse during T1 and another pulse at T3. The function of the T1 pulse is to precharge the intended signal at T3 similar to the Tekeda scheme. However, the control signal for the next row of the same color G2 is delayed by one pulse duration, i.e. the precharge pulse occurs during T2 and the addressing pulse occurs after T3. While the data signal is impressed at P11, the same data signal also precharges P31. Similar actions occur during T2 and T4. However, due to the alternate staggered timing of the pulses G1, G3, . . . to turn on the odd number rows and the pulses G2, G4, . . . to turn on the odd number rows and the pulses G2, G4, . . . to turn on the even number pulses, the polarities of the signal data impressed during odd and even time intervals are opposite as indicated by D1, and the resultant voltages impressed at the neighboring liquid crystals for the same color P11 and P21 are as shown. This inversion of voltage polarity for alternate rows is referred to as row inversion. Note that whenever the signal is changing in P11, there is no signal change in P21, because of the alternate timing of the control pulses. Since there is no signal change in P21, there can be no cross-talk.

Figure 1A:
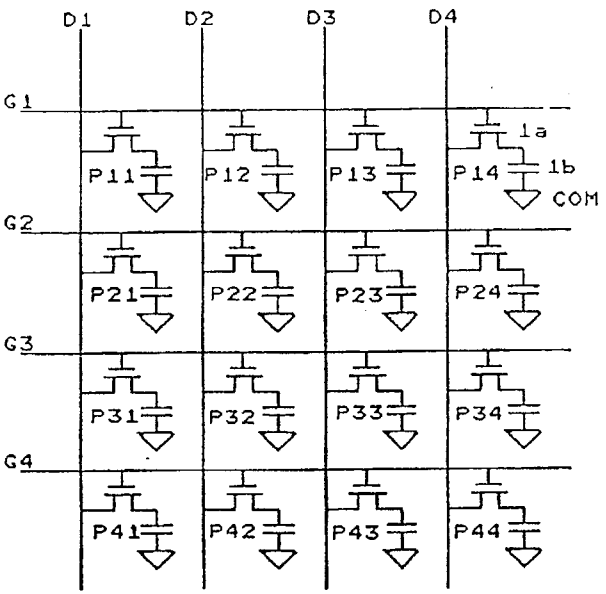
FIG. 1(A) shows the schematic of a prior art matrix liquid crystal display system.
Figure 1B:
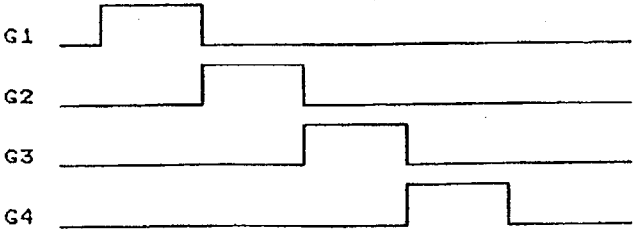
FIG. 1(B) shows the waveforms at different points in the system shown in FIG. 1(B).
Figure 2:
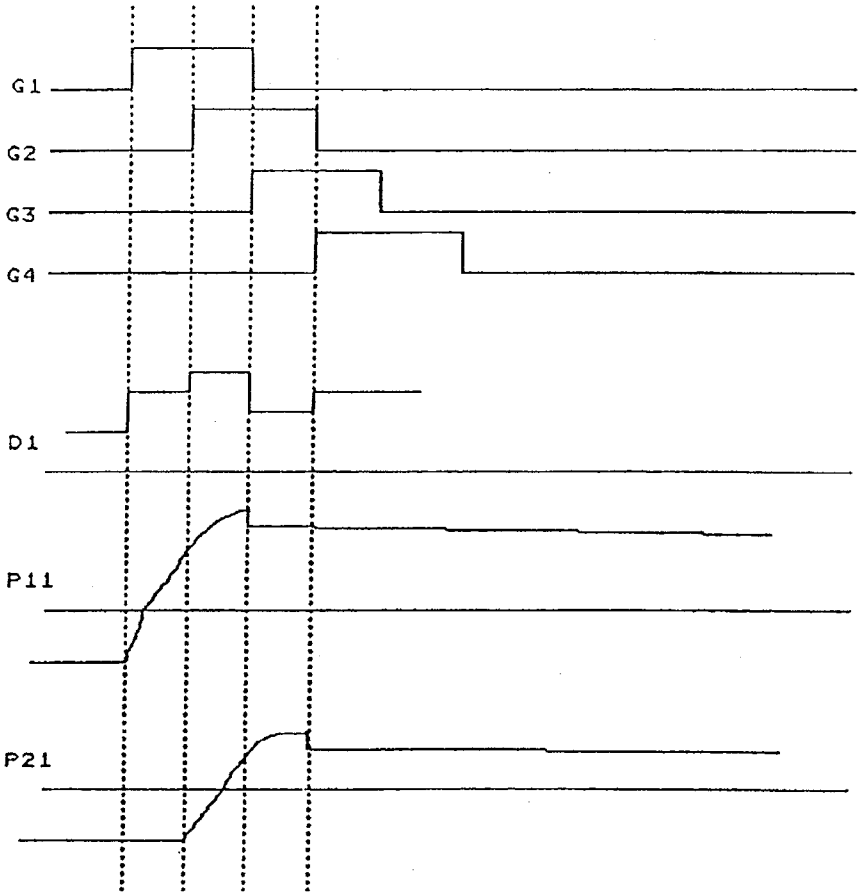
FIG. 2 PRIOR ART
FIG. 2 shows the waveforms at different points in an improved system according to Tekeda.
Figure 3:
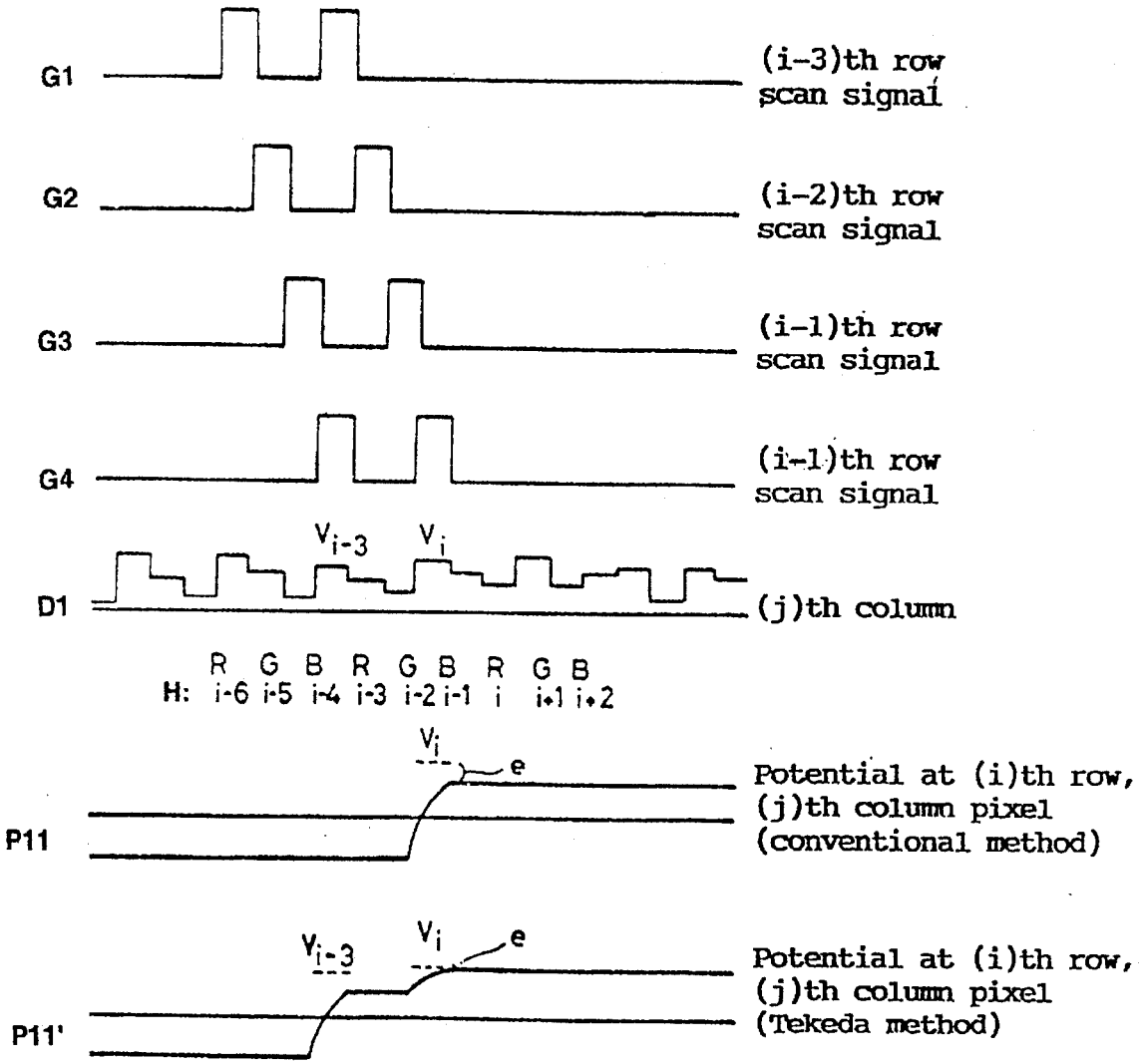
FIG. 3 PRIOR ART
FIG. 3 shows the waveforms at different points in another improved system according to Tekeda.
Figure 4C:
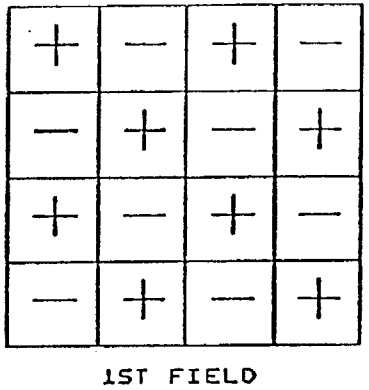
FIG. 4(C) shows the polarities at different points of the matrix using the dot inversion scheme according to another embodiment of this invention.
Figure 4C:
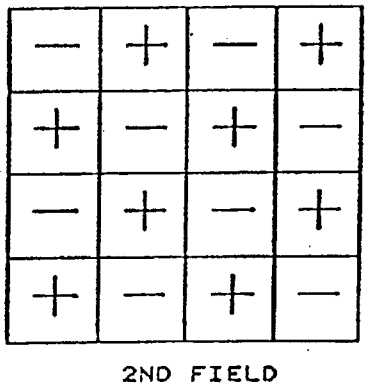
Figure 4B:
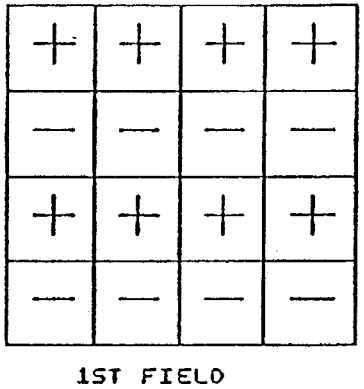
FIG. 4(B) shows the polarities at different points of the matrix using the row inversion scheme according to this invention.
Figure 4B:
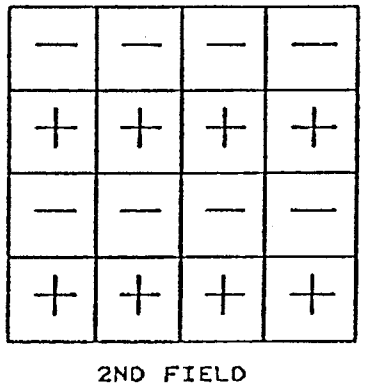
Figure 4A:
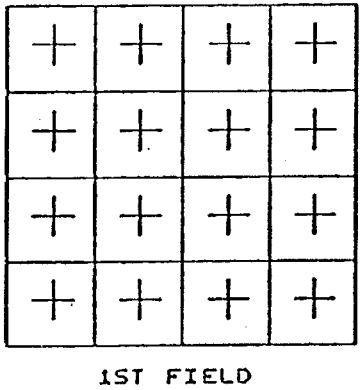
FIG. 4(A) PRIOR ART
FIG. 4(A) shows the polarities at different points of the matrix in the Tekeda's system at two alternate fields.
Figure 4A:
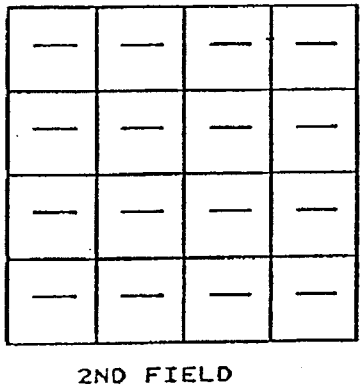
FIG. 4(A) PRIOR ART

Another feature of this invention is that the polarity inversion of the alternate rows is reversed in different fields as shown in FIG. 4(B). This same method to effect row inversion can also be used for dot inversion. FIG. 4(C) shows the dot inversion arrangement. The liquid crystals in the same line are alternately polarized. Thus, there is no cross-talk between neighboring dots in the vertical direction as well as the horizontal direction. As in the case of row inversion, the polarities in the two fields are reversed to reduce flicker. To effect dot inversion for the first embodiment, the signal data should be alternately polarized in the same row.

Figure 7:
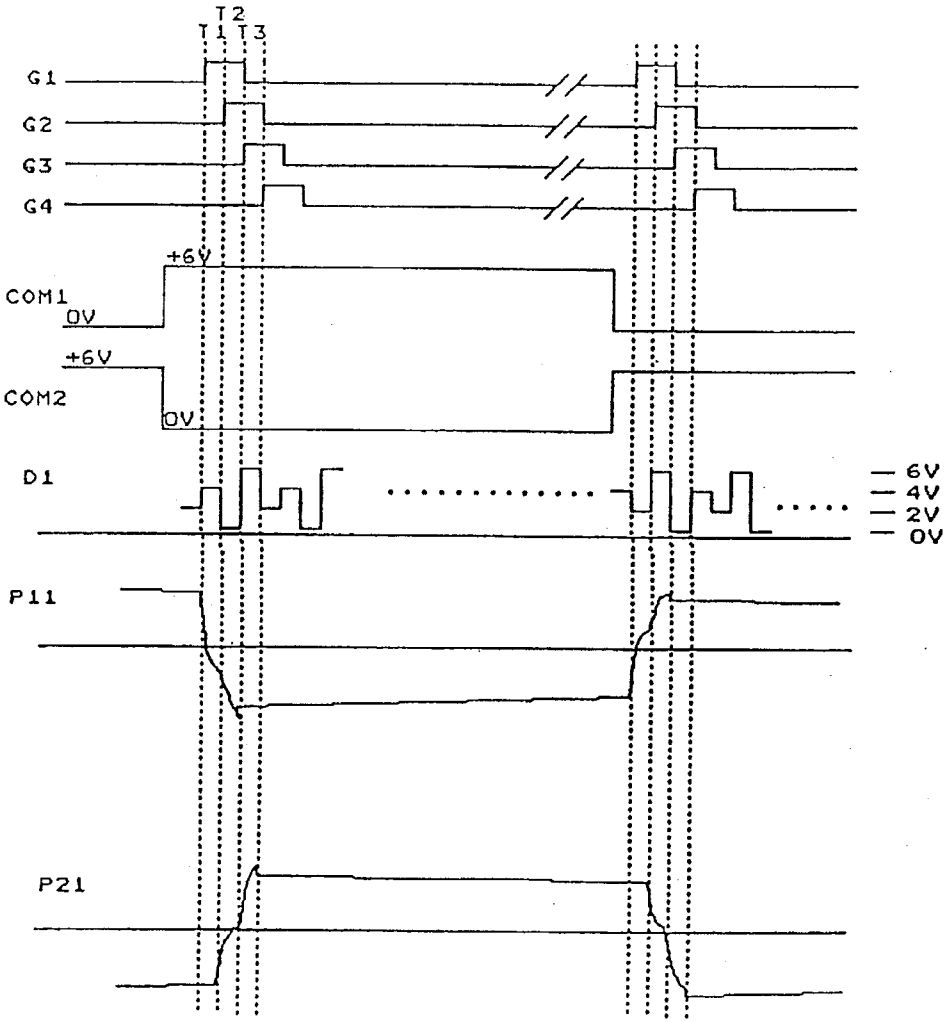
FIG. 7 shows the waveforms at different points of the circuit shown in FIG. 6.
Figure 6:
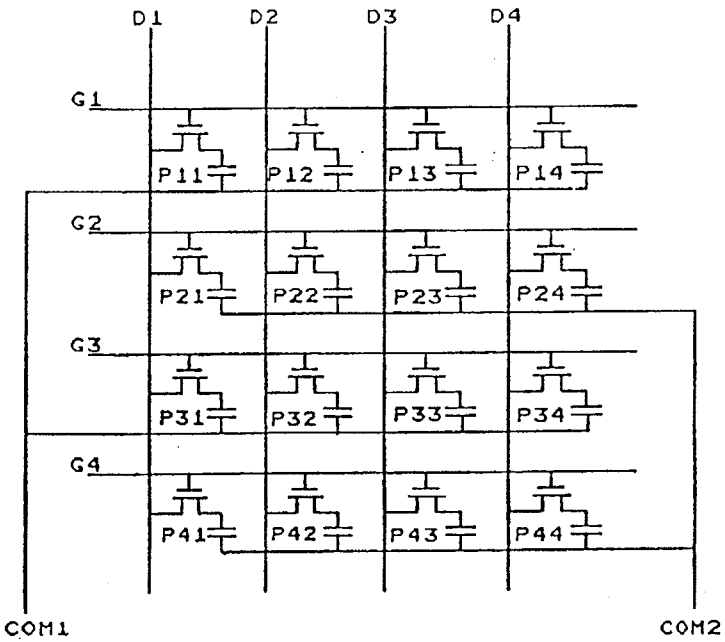
FIG. 6 shows another embodiment of the present invention using two different reference voltages for the liquid crystals.

A second embodiment of the present invention is shown in FIG. 6. In this arrangement, the common return paths of the liquid crystals of alternate rows are connected to two different common terminals COM1 and COM2. These two common terminals are connected to complementary voltages. For instance, when COM1 goes from 0 V to +6 V, COM2 goes from +6 to 0 V, as shown by the waveforms at different points of the circuit in FIG. 7. For a given data waveform D1, P11 is precharged to −2 V during T1, since D1−COM1=4−6=−2 V. During T2, P11 is then charged to the desired voltage, −6 V (since D1−COM1=0−6=−6 V). This sampled voltage is held until reset later. Meanwhile, P21 is precharged during T2 to Ov (D1−COM2=0−0=0 V) and charged to the data voltage 6 V (D1−COM2=6−0=6 V). In this manner, row inversion between adjacent rows is also effected. Besides, precharging is effected in one pulse duration H (H=T1=T2) to charge to addressed liquid to half the final value. As mentioned previously, row inversion can reduce cross-talk. To effect the second embodiment, the return paths of the liquid crystals in the same row should be alternately connected to COM1 and COM2.

In the foregoing description of this invention, the time duration of the driving pulses such as T1, T2, T3, etc. are plotted as equal to T (=horizontal scan time) or its multiple. It should be noted that these driving pulses can be made longer or shorter as described by Tekeda in U.S. Pat. Nos. 4,651,148 and 4,649,383.

What is claimed is:

1. An active matrix display system using picture elements (pixel) arranged in a X–Y matrix with m rows and n columns, comprising:

means for displaying a particular one of said pixels using X–Y coincident addressing of data signals and drive signals, a plurality of column electrodes having said data signals impressed, a plurality of row electrodes having said drive signals impressed, said drive signals sequentially scanning one of said rows to apply said data signals on said column electrodes to display pixels where said data signals and said drive signals are coincident, a plurality of switches, each having an input electrode, an output electrode and a control electrode, placed at cross-points of the column electrodes and the row electrodes, said switches having said row electrodes as said control electrodes, said column electrodes as said input electrodes of said switches, and said pixels connected to the output electrodes of said switches, said data signals having first polarities on odd-numbered said rows, and said data signals having polarities opposite to said first polarities on even-numbered rows.

2. A picture display system as described in claim 1, wherein said pixels are liquid crystals.

3. A picture display system as described in claim 1, wherein said switches are thin film field effect transistors with gates as said control electrodes, sources as said input terminals and drains as said output terminals.

4. A picture display system as described in claim 1, wherein said drive signals have double pulses for each scan line spaced by one dwell time of each said line, said double pulses appearing on each successive said row are delayed by one said dwell time, polarity of said data signal is reversed for adjacent said rows to effect row inversion.

5. A picture display system as described in claim 4, wherein said polarity of said data signal is reversed for every other field of said picture frame.

6. A picture display system as described in claim 1, wherein said drive signals have double pulses for each scan line spaced by one dwell time of each said line, said double pulses appearing on each successive said row are delayed by one said dwell time, polarity of said data signal is reversed for adjacent said row and adjacent said pixel on same row to effect dot inversion.

7. A picture display system as described in claim 6, wherein said polarity of said data signal is reversed for every other field of said picture frame.

8. A picture display system as described in claim 1, wherein said drive signal are pulses of longer duration than a dwell time of a line for precharging and charging a particular pixel, said pulses are delayed by one said dwell time for successive rows, said pixels have first common return paths for pixels of odd numbered rows and a second common return paths for pixels of even numbered rows, said first common return paths and second common return paths having complementary control voltages during one horizontal scan and having said complementary control voltages reversed during next horizontal scan to effect row inversion.

9. A picture display system as described in claim 8, wherein said complementary control voltages are reversed for every other field of said picture frame.

* * * * *